US005588646A

United States Patent [19]

Dickson

[11] Patent Number: 5,588,646

[45] Date of Patent: Dec. 31, 1996

[54] TETHERED BALL BATTING PRACTICE DEVICE

[76] Inventor: John W. Dickson, 16131 Fifth St., Lathrop, Calif. 95330

[21] Appl. No.: 521,391

[22] Filed: Aug. 1, 1995

[51] Int. Cl.[6] ..... A63B 69/40

[52] U.S. Cl. ..... 473/426; 473/453

[58] Field of Search ..... 273/58 C, 29 E, 273/26 E, 196, 198, 413, 414

[56] References Cited

U.S. PATENT DOCUMENTS

| | | | |
|---|---|---|---|
| 708,573 | 9/1902 | Miles | 273/29 A |
| 3,301,556 | 1/1967 | Hamilton | 273/26 E |
| 3,825,259 | 7/1974 | Burchett | 273/26 E |
| 3,861,679 | 1/1975 | Culpepper | 273/26 E |
| 4,735,413 | 4/1988 | Yamanouchi | 273/413 |
| 5,098,094 | 3/1992 | Kita | 273/413 |
| 5,340,101 | 8/1994 | Lawson | 273/413 |

*Primary Examiner*—Theatrice Brown

[57] ABSTRACT

A batting practice device, consisting of a framework with a horizontal base in the shape of a "T" with a vertical member affixed to the intersection of said horizontal "T". A second horizontal member centered and affixed to the top of said vertical member to form arms of a vertical "T" that are parallel to the arms of said horizontal "T". A ball target, baseball, softball, etc. is supported by a flexible means of suspension system. Whereas, the ball is supported at a degree of angle relative to the ground by two upper suspension members extending at outward angles to the top arm of the frame, and a lower suspension member extending outward to the lower tip of the base of the frame forming a "Y" configuration. Another, line of similar flexible means is attached to the intersection of said horizontal and vertical "T's", to stop return velocity of the ball after being hit by a bat. The framework is adjustable in height and length to facilitate lowering and raising the position of the ball. The framework is collapsible to allow ease of transportation.

17 Claims, 3 Drawing Sheets

TETHERED BALL BATTING PRACTICE DEVICE

BACKGROUND OF THE INVENTION

The present invention relates to devices used to practice hitting a baseball or softball.

While there are many forms of batting aids in prior art, ranging from simple to complex and from inexpensive to expensive, none of them successfully promote a correct ground ball, line drive swing. Typical prior art devices are found in U.S. Pat. Nos. 708,573; 1,105,329; 1,554,409: 2,058,277; 2,247,072; 2,839,300; 2,976,040; 3,006,647; 3,366,383; 3,454,275; 3,475,026; 3,830,494; 3,994,494; 4,010,950; 4,050,694; 4,138,107; 4,322,075; 4,415,155; 4,502,684; 4,508,340; 4,664,375; 4,828,262; 4,898,385; 5,048,828; 5,072,937; 5,340,101; 5,374,056 and all are not completely satisfactorily in all respects to the present invention. While all forms of prior art promote batting practice because, a ball is readily available to hit, none of the prior art emphasizes the correct swing that is so important in producing the ground ball, line drive hit.

Most prior art patents are deficient in one way, the ball is suspended vertically with a non flexible means, utilizing gravity to return the ball to a hitting position. A batter must wait between successive swings, or must be assisted in use of the device. Much of the prior art allows a mis-swing to falsely move the ball when the tethered support is struck by the bat.

Thus, what is needed is a device that returns the ball to a hitting position directly after each hit, as well as a device that only allows a well hit ball to be recognized as such.

SUMMARY OF THE INVENTION

The present invention's design is unique in that with proper use of the device, the device will train the user to swing more correctly than all other prior art of this type.

Within the scope of teaching or learning to bat it is often advantageous to isolate parts of the swing, so as to work on specific items of the swing. The present invention isolates the bat swing without regard to ball movement prior to the swing. An important objective of this invention is to allow the batter to swing when ready, without regard to a moving target, and then swing again without delay.

The present invention incorporates the use of a frame with horizontal and vertical members so constructed that set-up and collapsibility is possible without the use of any tools or other devices. To set-up the framework, the user need only repin the components in their respective set-up places, and reverse for transport and storage. The framework could be constructed of many different materials, however, the preferred embodiment would have the frame built of steel tubing to employ strength in the frame.

This invention incorporates a unique system of suspending a ball (baseball or softball) by a flexible means. The framework supports the suspension system at a degree of angle relative to the ground. Adjustments in the frame's height and length change the degree angle of the suspension system, therefore moving the location of the ball target higher or lower.

An inherent function of the present invention is that the hit must be nearly perfect in order for the ball target to travel fast enough and far enough for the bat to clear the suspending flexible means. After such a hit the ball returns readily, to be hit again.

In addition to the frame and suspension system a home plate may be set up to help the batter locate their stance. As well as a line for indicating the batters box.

DETAILED DESCRIPTION OF DRAWINGS

Figure 1:
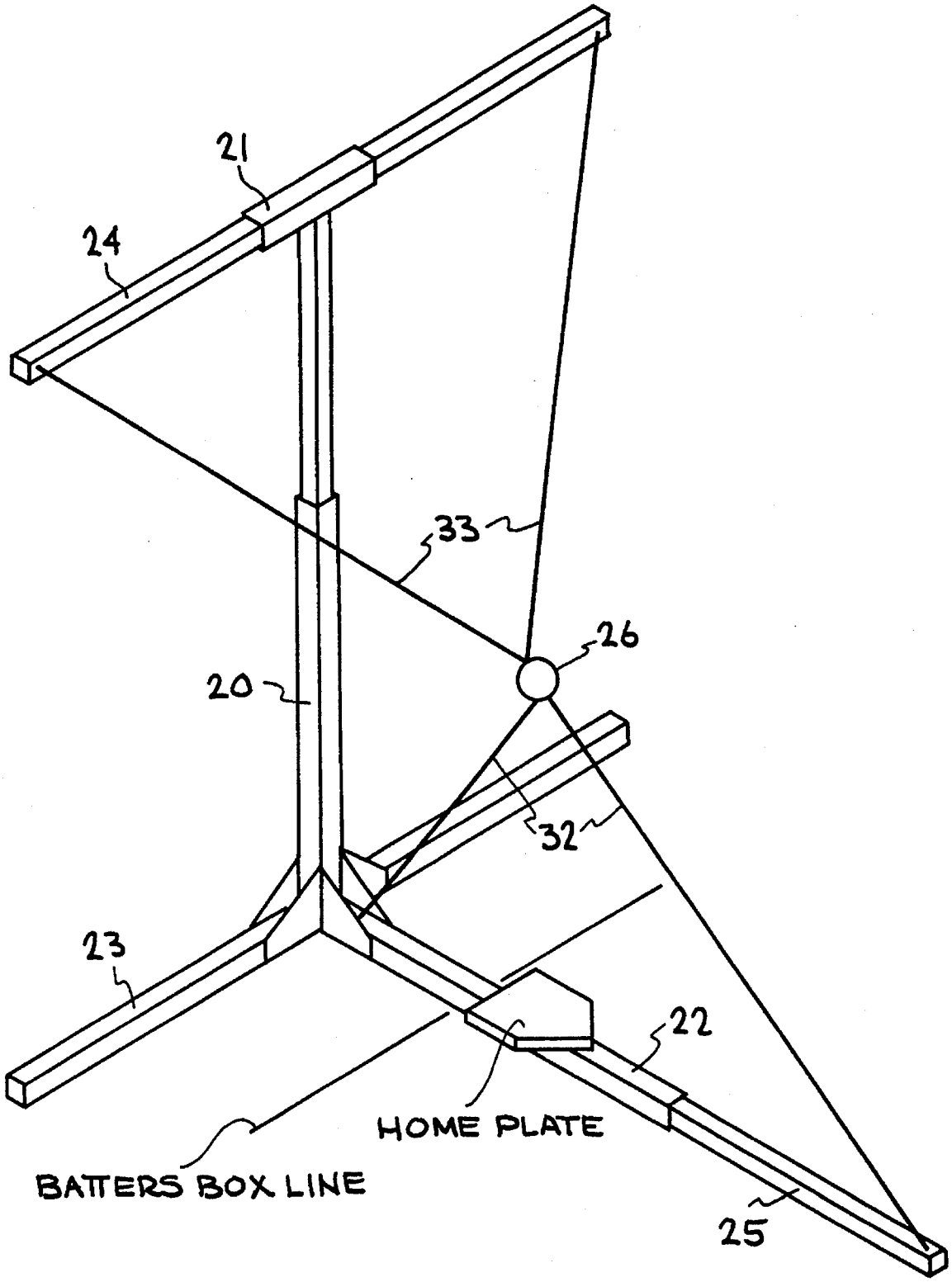
FIG. 1 A perspective view of the preferred embodiment of a batting practice device FIG. 2 A rear view illustration with an inset enlargement, and includes section A—A a cut away enlargement FIG. 3 A side view illustration including cut away enlargement, and showing a cut away view FIG. 4 An enlargement cut away view of FIG. 3's section B—B including an inset schematic view

Referring first to FIG. 1, therein is shown a perspective view of the preferred embodiment of a batting practice device. A horizontal frame base in the shape of a "T" is represented when horizontal member 22 and horizontal insert extension member 25 form the leg of said horizontal "T". Horizontal member 23 represents and forms the arms of said horizontal "T". First member 22 and horizontal "T" arms 23 affix to vertical member 20 adjoining gussetted weldment. Said vertical member 20 is extended by vertical insert extension member 21 and its adjoining weldment. Member 24 represents and forms the arms of a vertical "T" by affixing within said weldment of member 21. The vertical "T" arms 24 and the horizontal "T" arms 23 are parallel with respect to each other.

The prior mentioned members of FIG. 1 respectfully represent the framework of the preferred embodiment of a batting practice device wherein flexible means 32 and similar flexible means 33 form a system of flexible means of suspension when the middle of each adjoin as they intersect with, pass into, and secures to a ball target 26. First and second ends of flexible means 33 secure to the right and left ends of vertical "T" arms 24. First end of flexible means 32 secures to the outer end of horizontal insert extension member 25. The second end of flexible means 32 secures to the opposite end of horizontal member 22 at the intersection of the horizontal "T". First and second ends of flexible means 33 and first end of flexible means 32 form a "Y" configuration. Said "Y" configuration is supported by said framework at a degree of angle relative to the ground. Second end of flexible means 32 is used as a stop of the return velocity of the ball. Also included in FIG. 1 are the representations of a home plate and batters box lines.

Figure 2:
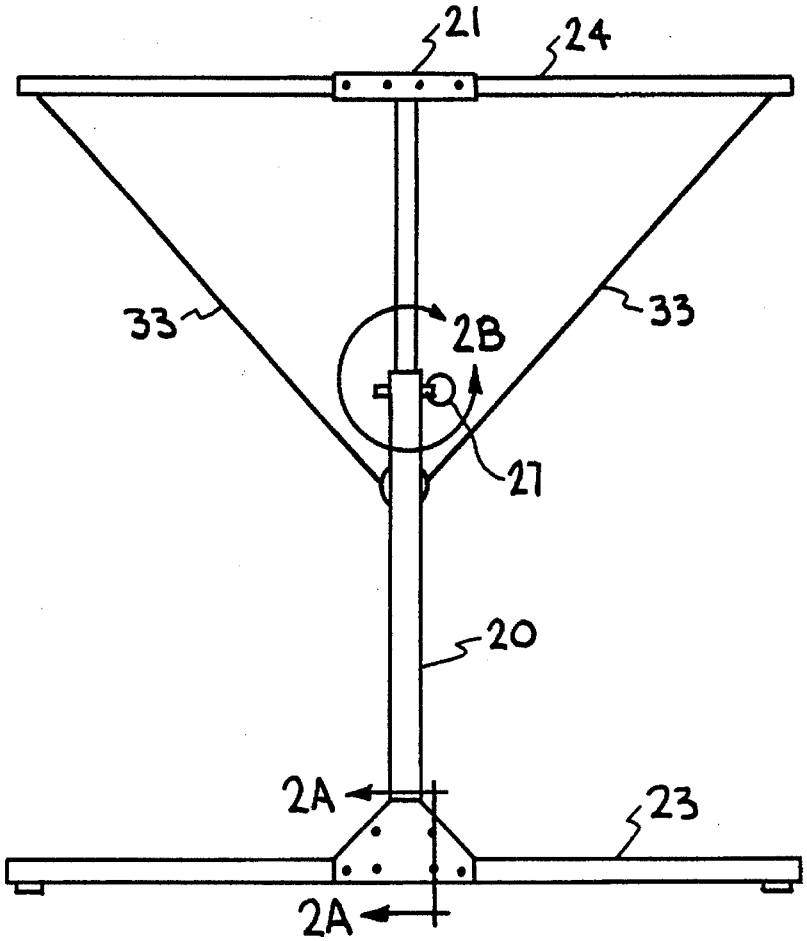
Figure 2A:
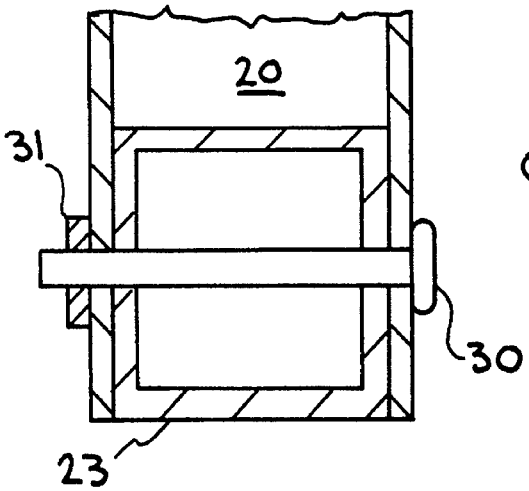
Figure 2B:
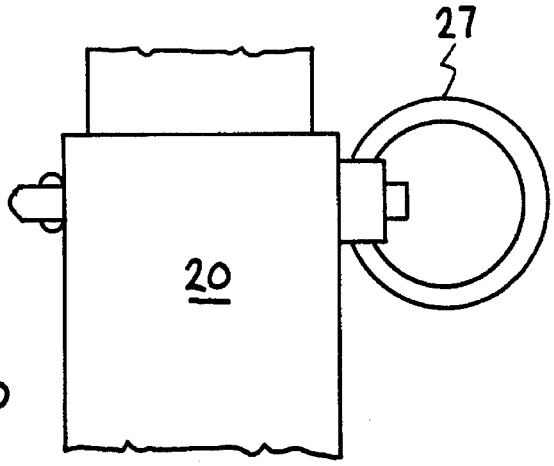

Referring now to FIG. 2 there is shown a rear view illustration with an inset enlargement, and includes section A—A a cut away enlargement. Herein which details are shown that are typical of the preferred embodiment of the batting practice device of FIG. 1. First inset enlargement shows a preferred connecting means of vertical member 20 and vertical insert extension member 21 where as a cotterless pin 27 is inserted through both members. This connecting means is also used in six other places within the framework of FIG. 1. References will be made later to connecting means of cotterless pin 27. When cotterless pin 27 is removed, vertical insert extension member 21 slides further inside of vertical member 20, to facilitate a collapsible state of the vertical extension of member 21.

FIG. 2's section A—A is a cut away enlargement of atypical connecting means used five places within the framework of FIG. 1. Herein is shown clevis pin 30 inserted through one side of vertical member 20's adjoining gusseted weldment, through right side horizontal "T" arm 23, and extending through the other side of said vertical member 20's gusset. Push nut 31 retains clevis pin 30 in place. The connecting means of clevis pin 30 and the retention means of push nut 31 will later be referred to as the connecting means of section A—A.

In further description of the affixing of vertical member 20 to horizontal "T" arms 23 the connecting means of section A—A is used 2 times; once for the right arm and another for the left arm. The connecting means of cotterless pin 27 is used twice to retain the horizontal "T" arms 23 in the shown position of FIG. 2; once for the right arm and once for the left arm. When cotterless pins 27 are removed from horizontal "T" arms 23, the two arms pivot on clevis pins 30 upward each to become parallel with vertical member 20, where the cotterless pins 27 are reinserted to retain horizontal "T" arms 23 in a collapsible state.

In further description of the affixing of vertical "T" arms 24 to the adjoining weldment of vertical insert extension member 21, the connecting means of section A—A is used twice; once for the right arm of vertical "T" arms 24, and again for the left. The connecting means of cotterless pin 27 is used twice to retain the two arms of vertical "T" arms 24 in shown horizontal position, when cotterless pins 27 are removed the two arms then pivot downward on clevis pins 30, each becoming vertical, to facilitate a collapsible state.

Figure 3:
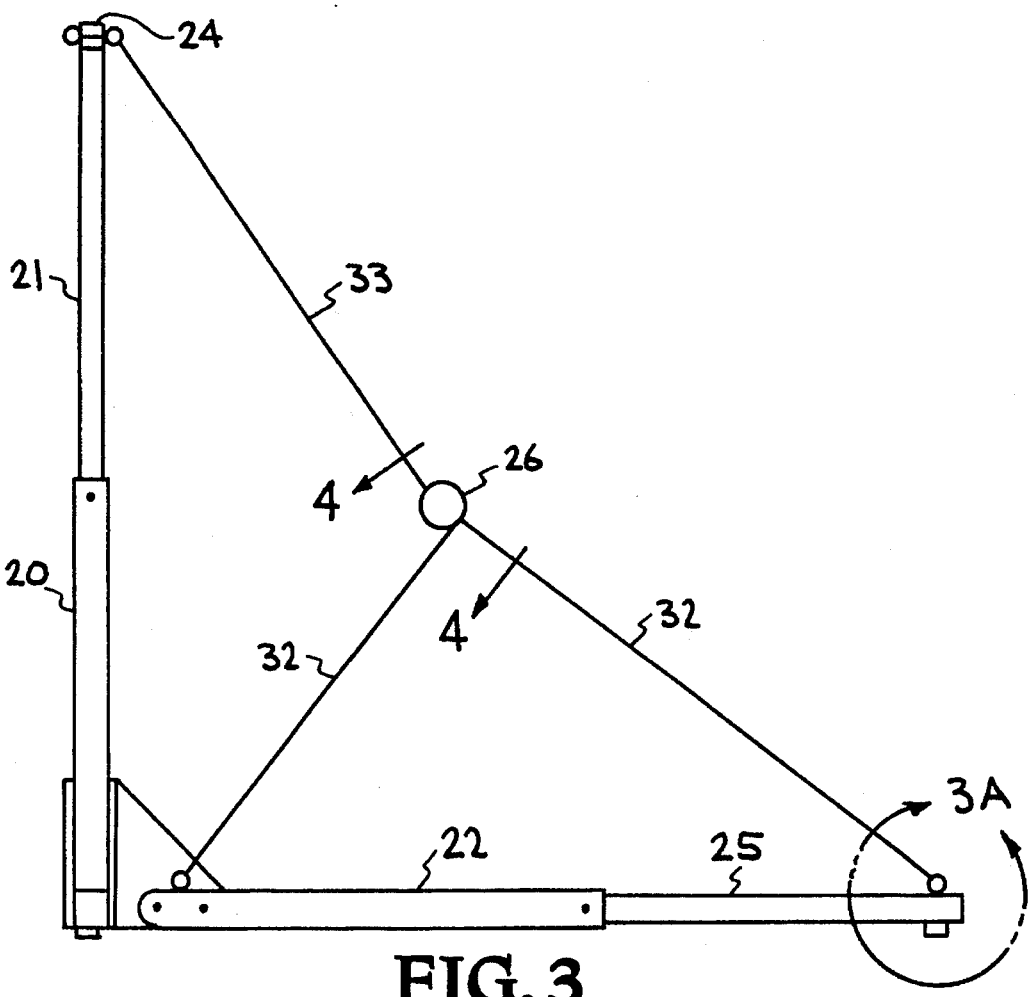
Figure 3A:
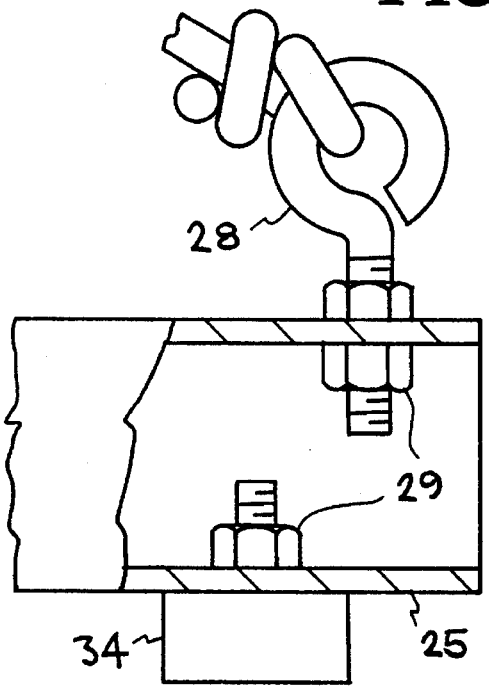

With reference to FIG. 3, where is shown a side view illustration with an inset enlargement of a cut away view and includes another cut away view of the preferred embodiment of a batting practice device of FIG. 1. Details within FIG. 3 will further explain some details of FIGS. 1 and 2, as well as FIG. 2 details will be further used as explanation in description of FIG. 3.

First horizontal member 22 is affixed to the adjoining gusseted weldment of vertical member 20. This is shown within a cut away view of the gusset of member 20. Horizontal member 22 is affixed to vertical member 20 with the use of the connecting means of section A—A in FIG. 2, horizontal member 22 is retained in the position shown with the connection means of cotterless pin 27 from FIG. 2. When cotterless pin 27 is removed horizontal member 22 may then pivot on clevis pin 30 (atypical of section A—A) to a vertical position in which cotterless pin 27 may be reinserted to retain member 22 vertically, to facilitate a collapsible state of horizontal member 22.

Horizontal insert extension member 25 is connected to horizontal member 22 by the connecting means of cotterless pin 27. This is the seventh atypical use of cotterless pin 27 shown in the inset enlargement of FIG. 2. Removal of cotterless pin 27 allows horizontal insert extension member 25 to slide further inside horizontal member 22, to facilitate a collapsible state.

In the inset enlargement of FIG. 3, horizontal insert extension member 25 is shown with a cut away to better describe two other atypical details. A rubber foot 34 is fastened to horizontal insert extension member 25 with nut 29. This rubber foot 34 is atypical with the outer ends of the horizontal "T" arms 23 as best seen in FIG. 2. Also shown in the inset enlargement of FIG. 3 another atypical is the fastening of eye bolt 28 with another nut 29 to horizontal insert extension member 25. Eye bolt 28 is further shown with one end of flexible means 32 secured with half hitch knot. Eye bolt 28 is atypical of three other locations, at the other end of flexible means 32 and the end of horizontal member 22 where horizontal member 22 connects with the gusseted weldment of vertical member 20 best seen for the cut away view. Eye bolt 28 is atypical again to both outer ends of vertical "T" arms 24, with the two ends of flexible means 33 secured to eye bolt 28 with half hitch knots. Vertical "T" arms 24 and flexible means 33 are best seen in FIGS. 1 and 2.

Figure 4:
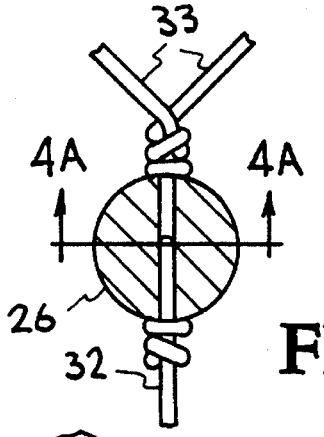
Figure 4A:
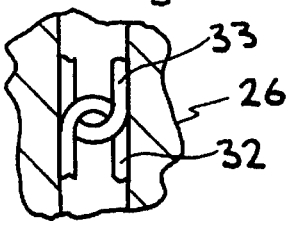

Take note of section markers B—B in FIG. 3, they will be referred to in the description of FIG. 4. Ball target 26 is suspended by flexible means 33 and similar flexible means 32 wherein details will be best explained in the description of FIG. 4.

FIG. 4 is a cut away enlargement of section B—B with an accompanying schematic view of inset. The cut away view of ball target 26 shows the intersection of flexible means 32 and similar flexible means 33, this is best understood with the schematic view of the inset. Both flexible means 32 and 33 are secured to ball target 26 with the use of a square knot on both respecting ends of a hole through ball target 26. Flexible means 32 and its intersection with flexible means 33, form a flexible means of suspension system.

This invention has been disclosed and described in its preferred form with a certain degree of particularity, it is understood that the present disclosure of the preferred form is only by way of example and that numerous changes in the details and arrangement of parts may be resorted to without departing from the spirit and scope of the invention as hereinafter claimed.

I claim:

1. A batting practice device consisting of:

a horizontal frame base having an intersection formed by a leg member and arm members interconnected in the shape of a "T", a vertical member affixed to the intersection of said horizontal "T", a horizontal member centered and affixed to the top of said vertical member to form arms of a vertical "T" that parallel arms of said horizontal "T", a flexible means forming a ball suspension system containing a target ball with first and second ends secured to ends of the arms of said vertical "T", a third end secured to an end of the leg member of said horizontal "T" to form a "Y" shape configuration angled at a degree relative to the ground, a fourth end secured to the intersection of said horizontal and vertical "T"'s to stop return velocity of the ball target after being hit, and said flexible means of said ball suspension system intersects with and is secured to said ball target to facilitate suspension of said ball target therein.

2. The batting practice device of claim 1 whereas:

the vertical member of said vertical "T" is adjustable in height.

3. The batting practice device of claim 1 whereas:

the leg of said horizontal "T" is adjustable in length.

4. The batting practice device in claim 1 whereas:

the framework of said device is constructed of tubing materials.

5. The batting practice device of claim 1 whereas:

the framework is composed of collapsible members.

6. The batting practice device of claim 1, additionally including a home plate indicator located along said horizontal base.

7. The batting practice device of claim 1, additionally including batters box line guides which intersect the leg member of said horizontal "T".

8. The batting practice device consisting of:

a T shaped horizontal frame base operatively connected to a vertical "T" shaped member and supporting a ball by means of attachment of a flexible means of suspension to a vertical height on said vertical member and along a horizontal plane of the horizontal frame base, whereas to facilitate suspension of said ball target at a degree of angle relative to the ground.

9. The batting practice device of claim 8, wherein said horizontal frame base and said vertical "T" shaped member, each include an adjustable member to enable adjustment in length.

10. The batting practice device of claim 8, wherein said flexible means is composed of four flexible sections interconnected to support the ball there between.

11. The batting practice device of claim 8 wherein each of said T shaped horizontal frame base and said vertical "T" shaped member is collapsible.

12. The batting practice device of claim 8, wherein said T shaped horizontal frame base and said vertical "T" shaped member are each composed of a plurality of interconnected sections.

13. A suspension system to support a ball target for batting practice, comprising:

a horizontal T-shaped member, a vertical T-shaped member connected to said horizontal T-shaped base member, and a plurality of flexible members connected to said horizontal T-shaped base member and said vertical T-shaped member, said flexible members being operatively interconnected to a ball target.

14. The suspension system of claim 13, wherein each of said horizontal T-shaped base member and said vertical T-shaped member is composed of a plurality of sections of tubing.

15. The suspension system of claim 14, wherein at least certain of said plurality of sections of tubing are adjustable in length.

16. The suspension system of claim 13, wherein said horizontal T-shaped base member is composed of a plurality of sections interconnected at a single point, wherein said plurality of sections are foldable at said single point; and wherein at least one of said plurality of sections is adjustable in length.

17. The suspension system of claim 16, wherein said vertical T-shaped member is connected to said horizontal T-shaped base member at said single point of said horizontal T-shaped base member, and wherein said vertical T-shaped member is composed of a plurality of sections, at least one of which is adjustable.

* * * * *